United States Patent [19]

Santilli

[11] 4,121,186

[45] Oct. 17, 1978

[54] INDICATING SECTIONAL COMPOSITE FUSE CONSTRUCTION USING STANDARD-TYPE FUSE LINK

[75] Inventor: James N. Santilli, Bloomington, Ind.

[73] Assignee: Westinghouse Electric Corp., Pittsburgh, Pa.

[21] Appl. No.: 730,097

[22] Filed: Oct. 6, 1976

Related U.S. Application Data

[63] Continuation of Ser. No. 633,189, Nov. 19, 1975, abandoned, which is a continuation of Ser. No. 519,724, Oct. 31, 1974, abandoned, which is a continuation of Ser. No. 67,183, Aug. 26, 1970, abandoned.

[51] Int. Cl.[2] ..... H01H 85/04

[52] U.S. Cl. ..... 337/161; 337/219; 337/237

[58] Field of Search ..... 337/158, 159, 161, 162, 337/168, 190, 177, 178, 181, 206, 237, 244, 267, 144, 201, 217, 292, 219

[56] References Cited

U.S. PATENT DOCUMENTS

| | | | |
|---|---|---|---|
| 2,096,983 | 10/1937 | Steinmayer | 337/219 |
| 2,483,577 | 10/1949 | Fahnoe | 337/161 |
| 2,809,254 | 10/1957 | Edsall | 337/162 |
| 3,467,934 | 9/1969 | Innis et al. | 337/190 X |

*Primary Examiner*—George Harris
*Attorney, Agent, or Firm*—W. A. Elchik

[57] ABSTRACT

An indicating sectional two-part fuse is provided having a high-current current-limiting section, and a low-current expulsion section, mechanically connected together, and in electrical series, the low-current section utilizing a standard-type fuse-link, which may be replaced. The high-current current-limiting section may contain one or more current-limiting type fuse elements, supported by an interrupter rod within an enclosed casing filled with an arc-extinguishing granular material, and the low-current expulsion section of the fusible device may comprise an open-ended fuse tube, through which the standard fuse-link may extend, with the cable of the fuse-link extending out of the open end of the fuse tube.

29 Claims, 8 Drawing Figures

INVENTOR
James N. Santilli
BY
Willard R. Crout
ATTORNEY

FIG. 4
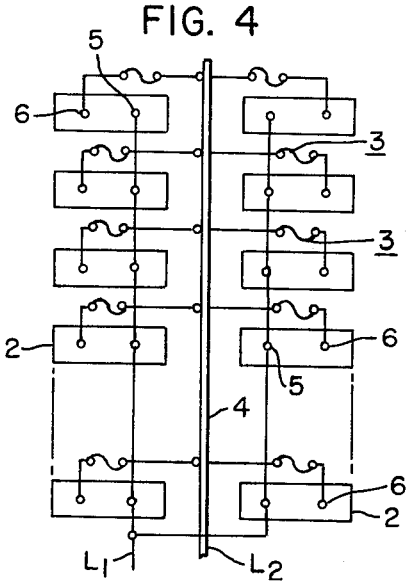
FIG. 4A
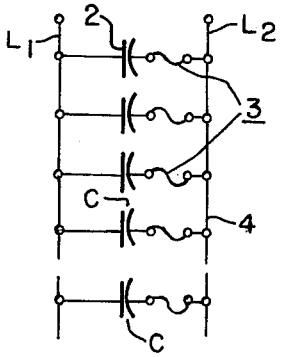
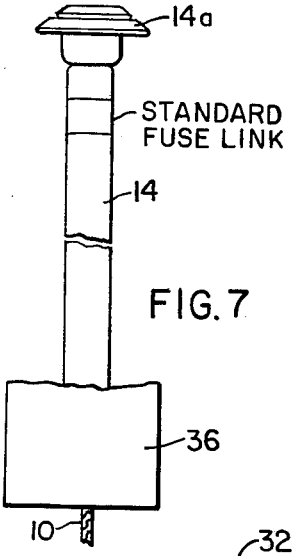
FIG. 7
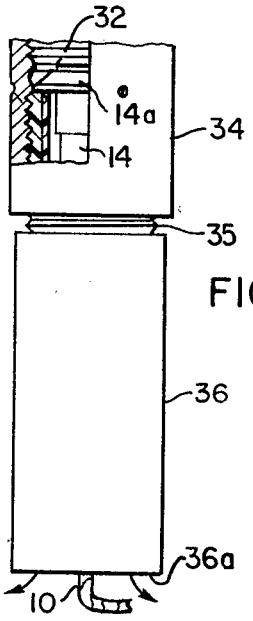
FIG. 6
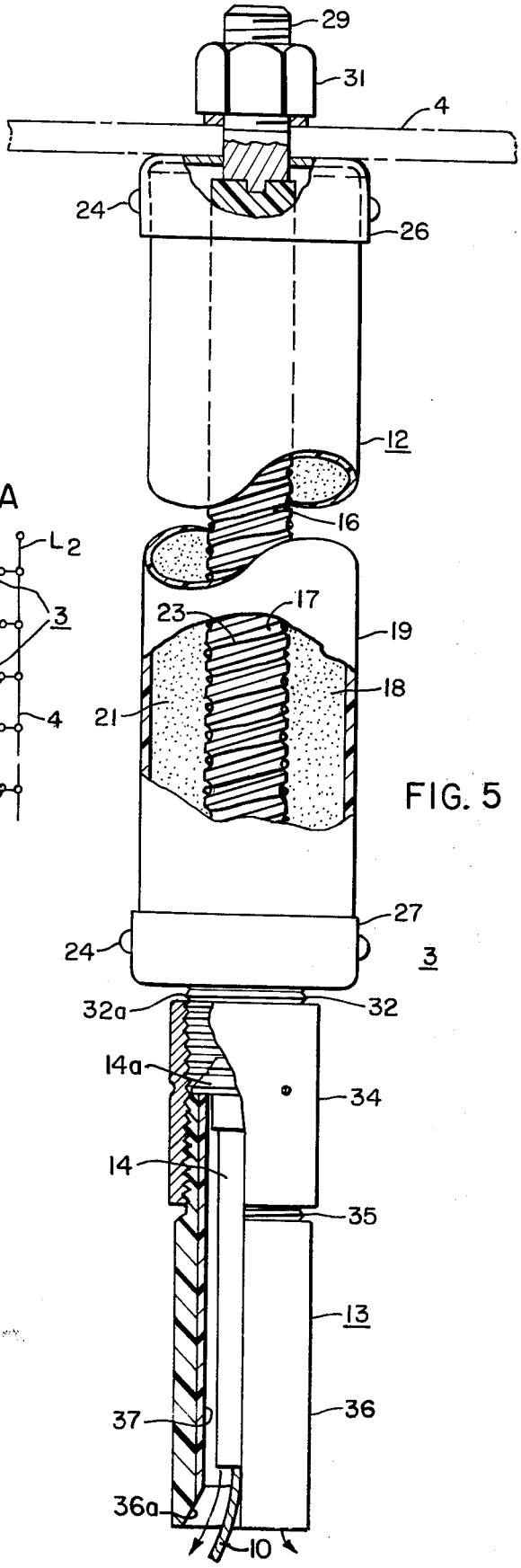
FIG. 5

INDICATING SECTIONAL COMPOSITE FUSE CONSTRUCTION USING STANDARD-TYPE FUSE LINK

CROSS-REFERENCES TO RELATED APPLICATIONS

The present patent application is a continuation of patent application Ser. No. 633,189, filed Nov. 19, 1975, which, in turn, was a continuation of patent application Ser. No. 519,724, filed Oct. 31, 1974, which, in turn, was a continuation of patent application Ser. No. 67,183, filed Aug. 26, 1970, all abandoned.

Patent application Ser. No. 622,279, filed Oct. 10, 1975 by Frank L. Cameron, and assigned to the assignee of the present application, may be pertinent to the present invention.

BACKGROUND OF THE INVENTION

In recent years, in electrical systems, the use of capacitor units for phase correction has become more and more common place. Capacitors are usually mounted in banks, and have any convenient, or desired kvar. ratings. It is very desirable to have a current-limiting fuse in series with each capacitor to prevent case rupture in the event of breakdown, and to prevent damage to the entire capacitor bank. Preferably, the fuse should be capable of disconnecting itself from the circuit, thereby eliminating tracking, which can cause oscilatory current which can damage other capacitors in the bank.

In one well-known type of capacitor-bank construction, an indicating fuse is mounted on the aluminum bus above each capacitor unit. Connection to the capacitor units is made by a flexible pigtail. The pigtail is passed through a coil-spring fuse-element ejector and indicator mounted up on the capacitor-unit terminal. The spring is held in a curved position when the fuse is intact. When the fuse blows, the spring retracts to a horizontal position, pulling the pigtail, or fuse link from the fuse-holder. Normally, the strain link of prior art fuses, that is, the link which resists the force of the coil spring is in tension, requiring that the link be firmly anchored at one end to a conductor rod, and be anchored at the other end to the pigtail of the fuse. An improved construction of such type is set forth in U.S. Pat. No. 3,259,719, issued July 5, 1966, to Robert T. Innis and George A. Rusnak, and assigned to the assignee of the instant application.

U.S. Pat. No. 3,467,934, issued Sept. 16, 1969 to Robert T. Innis and George E. Mercier, teaches a two-part indicating fuse adaptable for capacitor-unit protection, and including a flexible fuse casing. It is contempated in this patent that when fuse operation occurs, there will result a breakaway action between the two fuse casing sections of the device to thereby permit a visible indication of fuse operation.

SUMMARY OF THE INVENTION

In accordance with a preferred embodiment of the present invention, there is provided a dual current-limiting type of capacitor fuse incorporating two series sections, one being a high-current section, rendering a current-limiting action, and the other being a low-current section, rendering an expulsive action during its operation. Preferably, the two fuse sections are attached mechanically together, and the low-current section utilizes a standard fuse-link, which is readily replaceable. The low-current section employs an openended expulsion fuse-tube, through the open end of which extends the fuse-link cable.

During high-current or fault-current operation, the high-current element serves a current-limiting function, to thereby restrict the current flow to a safe magnitude until the fuse can isolate the faulted unit. During relatively low-current interruption, the fuse-link, within the expulsion unit, fuses, and provides an observable indicated condition of the fuse device.

It is, accordingly, a general object of the present invention to provide an improved dual sectionalized fuse, which utilizes a current-limiting section, and also an expulsion section, the latter using the universal-type fuse-link, readily obtainable in the open market.

It is a further object of my invention to provide an improved fuse with changeable minimum-melt fuse characteristics by reducing the standard link size at will for a particular application.

Another object of the present invention is to provide an improved indicating-type fuse for a capacitor unit, which will protect against gas generation internally within the capacitor casing, and which is of an improved construction.

Still a further object of the present invention is the provision of a two-part sectionalized fuse having a high-current section and a low-current section, the high-current section functioning to provide a current-limiting action, and the low-current section operating to use replaceable standard-type fuse-links.

Further objects and advantages will readily become apparent upon reading the following specification, taken in conjunction with the drawings.

BRIEF DESCRIPTION OF THE DRAWINGS

FIG. 4 illustrates, in vertical plan, the electrical diagram of a fuse connection to the central bus;

FIG. 4A illustrates diagrammatically the electrical components involved between the bank terminals;

FIG. 5 illustrates, to an enlarged scale, the improved protective fusible device of the present invention;

FIG. 6 illustrates the removable expulsion-type fuse-link holder of the improved fusible device of the present invention; and, FIG. 7 illustrates a conventional-type fuse-link with its flexible cable, which may be readily replaced within the expulsion-type fuse-holder of FIG. 6.

DESCRIPTION OF THE PREFERRED EMBODIMENT

Open structural-type capacitor banks, commonly referred to as "stack type" equipments, are the most economical method of obtaining large blocks of kilovars at voltages from 2400 volts up to the highest transmission voltages. Capacitor units are mounted and interconnected at the factory into a structural frame or "stacking unit". Large banks are assembled at field locations by bolting insulators and stacking units on top of each other and interconnecting them. Selection of the capacitor unit voltage and kvar. and the stacking unit size are dependent upon the system voltage, bank kvar. and manner of connection. Capacitor units rated 25, 50, 100 or 150 kvar., and from 2400 to 20,000 volts are arranged in series groups to match the system voltage. Sufficient units are connected in parallel in each series group to provide the required total bank kvar.

Figure 1:
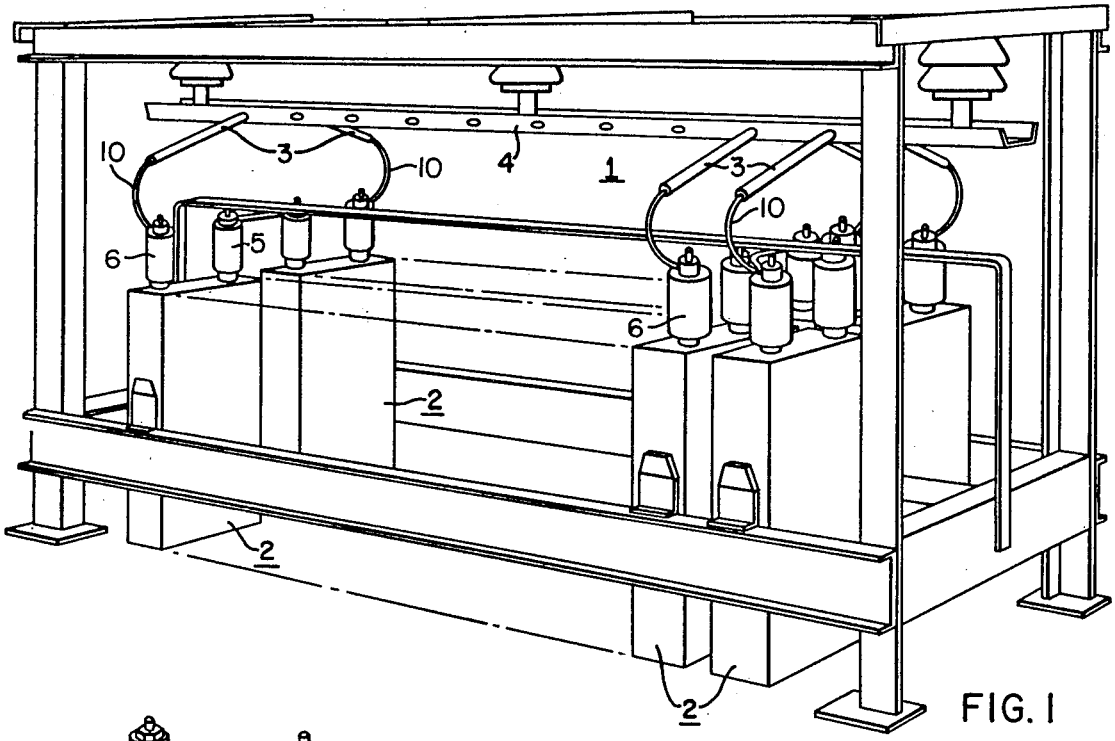
FIG. 1 illustrates, in perspective, a conventional capacitor bank incorporating an indicating-type of fuse according to the present invention.
Figure 2:
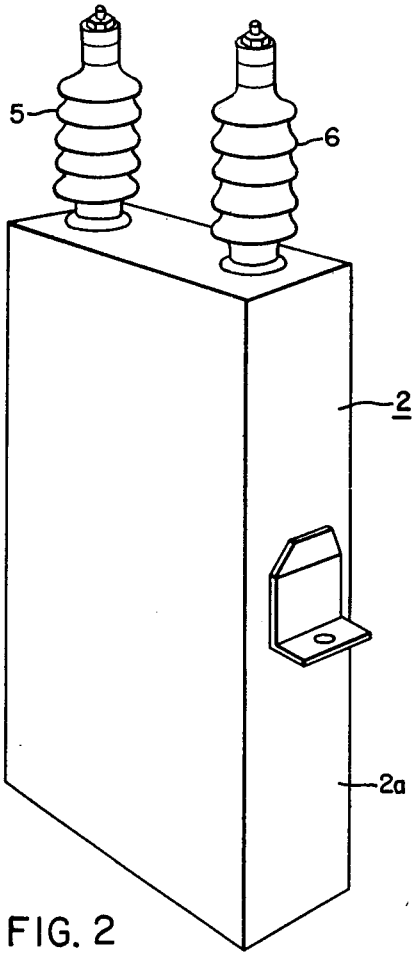
FIG. 2 illustrates, in perspective, a typical capacitor unit utilized in the conventional bank of FIG. 1.
Figure 3:
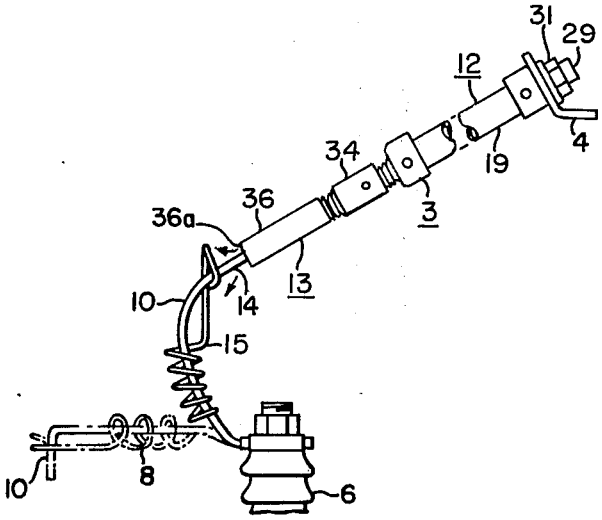
FIG. 3 illustrates more clearly, in side elevation, the improved fuse structure of the present invention, with the dotted lines indicating the observable blown condition of the fuse.

FIG. 1 illustrates a typical capacitor bank 1 comprising a plurality of capacitor units 2 having fuse connections 3 to the bus 4, with an individual fuse connection, such as illustrated in FIG. 3 of the drawings. The electrical connections are more readily apparent from an inspection of FIGS. 4 and 4A of the drawings. FIG. 2 illustrates a typical two-terminal capacitor unit 2, with terminal bushings 5, 6, and the dotted lines 8 in FIG. 3 illustrate the position of the fuse 3 indicating a blown condition, with the fuse pigtail 10 hanging downwardly, and the capacitor unit 2 completely isolated and disconnected from the central energized bus 4, as well as indicating for ease of maintenance.

The protective fusible device 3, in accordance with the present invention, as illustrated more clearly in FIGS. 3 and 5, comprises a dual-sectional fuse construction having a first current-limiting high-current section 12 and a second low-current expulsion unit 13, the latter accommodating standard fuse links 14. Generally, the internal construction of the high-current current-limiting section 12 is described in U.S. Pat. No. 3,259,719, issued July 5, 1966 to R. T. Innis and George A. Rusnak, and assigned to the assignee of the instant application. As shown, the high-current section 12 utilizes an interrupter rod 16 composed of steatite, or other suitable insulating material, and having one or more spiral grooves 17 extending the length thereof. The space or volume 18 inside the tube 19, between the wall of the tube 19 and the interrupter rod 16, is filled with a suitable material 21, such, for example, as white sand. The helical grooves 17 may contain main fuse wires 23, composed of silver, for example, or other conducting material, which run the length of the grooves 17. It will be understood that the main fuse wires 23 may be a single wire, or several strands of wire twisted together, depending upon the desired current-carrying capacity of the fuse device 3.

As shown, the casing 19 has secured to its upper and lower ends, as by staking pins 24, a pair of conducting caps or ferrules 26, 27, the upper cap 26 having a clamping stud portion 29, which extends through the bus 4, and is secured thereto by a mounting nut 31.

The lower cap, or ferrule 27 of the high-current current-limiting section 12 contains a mounting-stud portion 32, which is threaded externally, as at **32*a*, and accommodates the mounting sleeve 34, which is secured, as by a threaded connection 35, to an insulating expulsion-tube or fuse-holder 36, which may be fibre-lined at 37, as shown. The low-current expulsion-tube 36 utilizes a standard-type fuse-link 14, having a button head 14*a*, which is replaceable. As shown in FIG. 3, the flexible fuse-link cable 10 extends through the open lower end 36*a* of the expulsion fuse-tube 36, and it is electrically connected to the capacitor terminal 6, as shown in FIG. 3**.

There is a need for insuring that an operated or blown fuse 3 gives a positive observable indication when a piece of electrical equipment has partially, or completely failed. For instance, if a capacitor-unit 2 has partially, or completely failed, the fuse should operate to protect against gas generation internally inside the capacitor casing **2*a*, which could otherwise rupture the capacitor case. The fuse should also disconnect, and indicate a blown condition of the fuse, so the failed unit 2 will be completely disconnected from the circuit L1, L2, and a maintenance man can readily observe and locate the failed capacitor unit 2**, and thereby provide for replacement scheduling.

FIG. 3 shows the basic construction of an inexpensive current-limiting indicating fuse 3, with a replaceable low-current standard-type fuse-link element 14. The advantage of using this separate high-and-low-current fuse construction 3 is that the low-current element 14 is a standard fuse-link, and it is replaceable, if this element is damaged due to a partially-failed unit 2, parallel-unit failure, bus flashover, or shipping damage. The fuse construction 3 of the present invention also has a very good disconnecting and observable indicating feature, since the low-current element 13 has the fuse-link cable 10 objected through the open and **36*a* of the fuse-tube 36**, either on high-or low-current operation.

It will be obvious that during heavy fault current interruption, the high-current interrupting section 12 provides a current-limiting feature, which restricts the current flow to a safe magnitude, as the fuse 3 is isolating the faulted unit. During this same high-current interruption, as will be obvious, the low-current section 13 will also fuse, and eject the fuse-link cable 10 out of the open end **36*a* of the expulsion-tube section 36. Thus, during such high-current interruption, which occurs at high speed, the danger of case rupture and damage to adjacent units 2** is eliminated.

Under fault conditions, the fusible elements 23 inside the high-current unit 12 melt and/or vaporize, and the fused metal, within the current-limiting section, condenses in the sand 21 surrounding the assembly 16. The ensuing arc is confined in the spiral grooves 17 in the interrupter bar 16 by the sand 21. This restriction of the arc produces a high arc voltage, which opposes the system voltage, and limits the fault current to a safe value. The energy generated in the current-limiting section 12 is absorbed by the quartz sand 21.

During low-current operation, the fusible section, constituting a part of the replaceable fuse-link 14, fuses and the gases, which are generated within the fibre-lined expulsion tube 36, eject the fuse-link cable 10 out of the open end **36*a* of the expulsion-tube 36 to an indicating position 8, as shown more readily in FIG. 3 of the drawings. The high-current section 12** is not affected during such low-current operation.

It is to be observed that should the low-current section 13 become damaged, or otherwise unsuitable for use, the entire low-current unit 13 may be readily unscrewed from the mounting stud 32 of the high-current unit 12, and an entire new low-current unit 13 may be utilized. During normal operation, however, only the universal cable-type fuse-link 14 will need to be replaced, as well known by those skilled in the art. Thus, the improved fusible protective device 3 of the present invention utilizes a standard replaceable fuse-link 14 during normal operation.

For a particular application, by way of example, the individual capacitor units 2 each had a 150 kvar. rating, the voltage of the line was 20 K.V., and the normal operating current of the individual capacitor unit 2 was 7.5 amperes. With regard to the fusible device 1, there were 3 smooth silver wires, each of 0.02 inches diameter, laid together side-by-side in a single groove 17 formed on the interrupter rod 16 of the high-current unit 12. The fuse-link rating of the low-current unit was 12 amperes.

Although the invention has been described with particular relation to a capacitor unit 2, where it has particular suitability; nevertheless, it is to be understood that the improved fusible protective device 3 of the present invention could be used with other electrical equipment, other than capacitor units, such as a transformer, instrument, etc., as will be obvious.

To assist in the ejection of the fuse-link cable 10, a spring device 15, secured to the capacitor terminal 6, may be employed to assist in such ejection action. However, for certain application, it may not be necessary to use the spring device 15, and the generation of gases internally within the expulsion tube 36 may alone be relied upon to effect ejection and an indicating ejection position of the fuse-link cable 10.

Although there has been illustrated and described a specific structure, it is to be clearly understood that the same was merely for the purpose of illustration, and that changes and modifications may readily be made therein by those skilled in the art, without departing from the spirit and scope of the invention.

I claim:

1. An indicating-type fusible device comprising a first high-current current-limiting section and a second relatively low-current expulsion section mechanically connected together in electrical series relation, the second relatively low-current expulsion section accommodating a standard-type fuse link, which may readily be replaced following fusing of the second relatively low-current expulsion section whereby changeable minimum-melt fuse characteristics are possible, and said first and second fusible sections remaining electrically and mechanically interconnected following any type of fuse rupture.

2. The combination of claim 1, wherein the first current-limiting section contains an interrupter-rod having one or more spiral grooves thereon extending the length of the interrupter rod.

3. An indicating-type fusible device, comprising a first current-limiting section and a second expulsion section mechanically connected together in electrical series relation, said first current-limiting section comprising an interrupter rod disposed within an insulating casing, and having one or more spiral grooves extending the length of the interrupter rod, the second expulsion section comprising a standard-type fuse-link and an attached flexible fuse-link cable, the second expulsion fusible section additionally including an open-ended expulsion fuse tube, and said first and second fusible sections remaining electrically and mechanically interconnected following any type of fuse rupture.

4. An indicating-type two-part fusible device comprising a high-current part and a mechanically-connected low-current part, the high-current part exercising a current-limiting function, and the second part exercising an expulsion action, the first part comprising an enclosed casing at least partially filled with a granular arc-extinguishing material and an insulator support supporting one or more fusible elements, the second part comprising an open-ended expulsion tube utilizing a standard fuse-link with the flexible cable thereof extending out the open end of the expulsion tube.

5. An indicating-type fusible device comprising, in combination, a current-limiting fuse unit and an expulsion-type fuse holder mechanically connected in end-to-end abutment by a removable connection, the current-limiting fuse unit having one or more fusible elements and exercising a current-limiting action, said expulsion-type fuse holder having an open-ended fuse tube and a standard-type fuse link with a flexible fuse-link cable, the flexible fuse link cable extending out of the open end of the fuse tube, and the current-limiting fuse unit and the expulsion-type fuse holder remaining electrically and mechanically interconnected following any type of fuse rupture.

6. The combination according to claim 5, wherein the expulsion-type fuse holder screws onto a stud portion of the current-limiting fuse unit.

7. The combination of claim 6, wherein the button of the fuse link is placed under compression by said stud portion of the current-limiting fuse unit.

8. A current-limiting, indicating-type fusible device, comprising, in combination:

(a) a first fuse-unit comprising means defining an enclosed current-limiting fuse;

(b) one or more current-limiting fuse-elements disposed within said enclosed current-limiting fuse adaptable to fuse upon the passage therethrough of relatively-high-fault currents of relatively-high amperage value;

(c) a second fuse-unit for interrupting relatively low-amperage-value currents comprising means defining an expulsion-type, open-ended fuse-tube holder and an ejectable standard-type fuse-link disposed therein having a fuse-link cable extending out of the open end of said expulsion-type fuse-tube holder;

(d) means removably, detachably, mechanically mounting said first and second fuse-units in electrical-series relationship;

(e) means biasing the fuse-link cable to an indicating open-circuit position tending to withdraw the said standard-type fuse-link cable out from the open end of said open-ended, expulsion-type fuse-tube holder;

(f) both the first and second fuse-units simultaneously fusing upon the occurrence of high-current interruptions to thereby establish two arcs in electrical series for combined fast arc-interrupting activity; and, (g) only the second fuse-unit fusing upon the occurrence of relatively low-amperage-value current interruptions, while the said first fuse-unit remains unaffected and intact capable of further use in said fusible device.

9. A composite protective two-sectional current-limiting fuse device comprising a high-current, current-limiting enclosed interrupting section having one or more current-limiting fuse links enclosed therein, a mechanically connected low-current expulsion-type open-ended interrupting section with a standard-type fuse-link and cable therein, said low-current expulsion-type interrupting section being mechanically detachably secured to the high current-limiting section so that the fuse elements of the two sections are connected in electrical series, including an open-circuit-biased indicating fuse-link cable in said low-current section, whereby on low-current interruption the low-current section only need be replaced in a fusereplacement operation, and on high-current interruption two series arcs are established for fast interruption.

10. A fuse as claimed in claim 9, in which the low-current open-ended interrupting section comprises an expulsion tube having an open end and the standard-type fuse-link cable attached to the standard-type fuse link is retracted out of the open end of the expulsion tube upon fusion of the lower-melting-temperature standard-type fuse link disposed within said low-current open-ended fuse section when the fuse device "blows".

11. A composite protective current-limiting fuse comprising, in combination, a first high-current current-limiting completely-enclosed interrupting section and a mechanically-connected second low-current expulsion-type interrupting section, said second low-current expulsion-type interrupting section including a pull-away, indicating, standard-type fuse and fuse-link cable, whereby on low-current interruptions, the low-current expulsion-type second section only need be replaced in a refusing operation and both fuse sections fusing simultaneously on high-current interruption to thereby establish two arcs in electrical series, and first and second fusible sections remaining electrically and mechanically interconnected following any type of fuse rupture.

12. The combination of claim 11 wherein the first current-limiting fuse section is an enclosed cartridge at least partially filled with sand.

13. The combination according to claim 11 wherein the first high-current current-limiting interrupting section has a threaded end stud portion, and the second low-current interrupting section may be screwed upon said threaded end stud portion of the first section.

14. A composite protective expulsion-type current-limiting open-ended fuse comprising, in combination:

(a) means defining a first high-current, cartridge-type, completely-enclosed, current-limiting-type interrupting section;

(b) means defining a second tubular, open-ended, expulsion-type, low-current interrupting section;

(c) means for detachably mechanically interconnecting the first high-current interrupting section and the second low-current expulsion interrupting section together for separable replacement;

(d) said second low-current, expulsion-type, interrupting section including a standard-type fuse-link and a connected fuse-link standard-type cable with the fuse-link cable extending out the open end of the second low-current fuse-tube casing;

(e) means for tensioning the standard-type fuse-link cable so that both on low-current interruption and on high-current interruption the standard-type fuse-link cable will be pulled out of the fuse casing by said tensioning means externally to a visual indicating position of the current-limiting fuse;

(f) the characteristics of the first current-limiting section being such as not to fuse during low-current interrupter; and, (g) both first and second interrupting sections substantially simultaneously fusing on high-current conditions so that advantage may be taken of both interrupting capacities on high-current interrupter in establishing two series arcs.

15. An indicating-type, composite, current-limiting fusible device comprising, in combination:

(a) means defining a first high-current-interrupting, current-limiting type, completely-enclosed fusible section;

(b) means defining a second relatively-low-current-interrupting, expulsion-type, fuse-section;

(c) means mechanically connecting said first and second fuse sections together in electrical-series relationship;

(d) said second relatively-low-current-interrupting, expulsion-type, fuse-section including a standard-type pull-away indicating fuse-link and fuse-link cable;

(e) means biasing said indicating standard-type fuse-link and fuse-link cable to an open-circuit indicating position;

(f) only the second relatively-low-current-interrupting, expulsion-type, fuse-section fusing on relatively-low-current interruptions whereby on relatively low-current interruptions the said second low-current-interrupting expulsion-type, fuse-section only need be replaced in a refusing operation; and, (g) the said current-limiting fusible device so operating and the said first and second fuse-sections so functioning as to simultaneously fuse on high-current interruptions so that two resultant series arcs are thereby established on said such high-current interruptions.

16. An indicating-type fusible device comprising a first high-current current-limiting fusible section and a second relatively-low-current expulsion fusible section mechanically connected together in electrical series relationship, the second relatively-low-current expulsion fusible section accommodating a standard-type fuse-link connected to a flexible fuse-link cable, the second relatively-low-current expulsion fusible section additionally including an open-ended fuse-tube having said flexible fuse-link cable extending out of the open end thereof, means providing a ready replacement of said standard-type fuse-link and attached fuse-link cable following fusing of said second relatively-low-current expulsion fusible section, whereby changeable minimum-melt fuse characteristics are possible, and said first and second fusible sections remaining electrically and mechanically interconnected following any type of fuse rupture.

17. A composite protective two-sectional current-limiting fuse device comprising a high-current, current-limiting enclosed interrupting section having one or more current-limiting fuse-links enclosed therein, a mechanically connected low-current expulsion-type open-ended interrupting section with a standard-type fuse-link and cable therein, said low-current expulsion-type interrupting section being mechanically detachably secured to the high-current current-limiting fuse section so that the fuse elements of the two fusible sections are connected in electrical series, including an open-circuit-biased indicating fuse-link cable in said low-current fusible section, whereby on low-current interruption, the low-current fusible section only need be replaced in a fuse-replacement operation, and on high-current interruption two series arcs are established for fast current interruption, the current-limiting high-current fusible section being an enclosed cartridge at least partially filled with sand, and the high-current current-limiting interrupting fusible section and the low-current interrupting fusible section remaining electrically and mechanically interconnected following any type of fuse rupture.

18. A composite protective two-sectional current-limiting fuse device comprising a high-current, current-limiting enclosed interrupting section having one or more current-limiting fuse links enclosed therein, a mechanically connected low-current expulsion-type open-ended interrupting section with a standard-type fuse-link and cable therein, said low-current expulsion-type interrupting section being mechanically detachably secured to the high current-limiting section so that the fuse elements of the two sections are connected in electrical series, including an open-circuit-biased indicating fuse-link cable in said low-current section, whereby on low-current interruption, the low-current section only need be replaced in a fuse-replacement operation, and on high-current interruption two series arcs are established for fast current interruption, the low-current open-ended interrupting section comprising an expulsion tube having an open end and a standard-type fuse-link cable attached to the standard-type fuse-link being retracted out of the open end of the expulsion tube upon fusion of the lower-melting-temperature standard-type fuse-link disposed within said low-current open-ended fusible section when the fusible device "blows," and the current-limiting high-current fusible section being an enclosed cartridge at least partially filled with sand, and the high-current fusible section and the low-current interrupting fusible section remaining electrically and mechanically interconnected following any type of fuse rupture.

19. The combination according to claim 17, wherein the high-current current-limiting fusible section has a threaded end stud portion, and the low-current open-ended expulsion fusible section being screwed upon said threaded end stud portion.

20. The combination according to claim 18, wherein the high-current current-limiting fusible section has a threaded end stud portion, and the low-current open-ended expulsion fusible section being screwed upon said threaded end stud portion.

21. A composite protective current-limiting fuse comprising, in combination, a first high-current current-limiting completely-enclosed interrupting section and a mechanically-connected second low-current expulsion-type interrupting section, said second low-current expulsion-type interrupting section including a pull-away, indicating, standard-type fuse and fuse-link cable, whereby on low-current interruptions, the low-current expulsion-type second section only need be replaced in a re-fusing operation and both fuse sections fusing simultaneously on high-current interruption to thereby establish two arcs in electrical series, the second low-current interrupting section comprising an expulsion tube having an open end, the standard-type fuse-link cable attached to the standard-type fuse-link being retracted out of the open end of the expulsion tube, and the first and second fusible sections remaining electrically and mechanically interconnected following any type of fuse rupture.

22. A composite dual-acting protective fuse comprising, in combination, means defining a high-current current-limiting completely enclosed interrupting fuse section and a mechanically connected low-current expulsion-type interrupting fuse section, said low-current expulsion-type interrupting fuse section including a standard-type fuse-link with a pull-away indicating fuse-link cable which is completely pulled out of said low-current expulsion-type fuse section following all fuse operations, whereby on low-current interruption, the low-current standard-type fuse-link only need be replaced in a re-fusing operation and both the high-current and low-current fuse sections fusing simultaneously on high-current interruptions, and the two fusible sections remaining electrically and mechanically interconnected following any type of fuse rupture.

23. The combination according to claim 22 wherein the low-current interrupting fuse section comprises an expulsion tube having an open end and the standard-type fuse-link cable is retracted completely out of the open end of the expulsion tube following fuse operation to a visible open-gap disconnecting position.

24. The combination of claim 23 wherein the current-limiting fuse is an enclosed cartridge at least partially filled with sand.

25. The combination according to claim 23 wherein the high-current current-limiting interrupting section has a threaded end stud portion, and the low-current interrupting section may be screwed upon said threaded end stud portion.

26. A composite protective expulsion-type open-ended fuse comprising, in combination:

(a) means defining a high-current, cartridge-type, completely-enclosed, current-limiting-type interrupting section;
(b) means defining a tubular, open-ended, expulsion-type, low-current interrupting section;
(c) means for detachably mechanically interconnecting the high-current interrupting section and the low-current expulsion interrupting section together for separable replacement;
(d) said low-current, expulsion-type, interrupting section including a standard-type fuse-link and a connected flexible fuse-link cable with the flexible fuse-link cable extending out the open end of the low-current fuse-tube casing;
(e) means for tensioning the fuse-link cable so that both on low-current interruption and on high-current interruption the fuse-link cable will be completely pulled out of the fuse casing by said tensioning means externally to a visual indicating open-gap disconnecting position of the fuse;
(f) the characteristics of the current-limiting section being such as not to fuse during low-current interruption;
(g) both interrupting sections substantially simultaneously fusing on high-current conditions so that advantage may be taken of both interrupting capacities on high-current interruption; and,
(h) the two fusible sections remaining electrically and mechanically interconnected following any type of fuse rupture.

27. An indicating-type, composite, fusible device comprising, in combination:

(a) means defining a first high-current-interrupting, current-limiting-type, completely enclosed fusible section;
(b) means defining a second relatively low-current-interrupting, expulsion-type, fuse section;
(c) means mechanically connecting said first and second fuse sections together in electrical series relationship;
(d) said second relatively low-current-interrupting, expulsion-type, fuse section including a standard-type fuse-link and a pull-away fiexible indicating fuse-link cable which is completely pulled out of said low-current expulsion-type interrupting fuse section following fuse operation to a visible open-gap disconnecting position;
(e) means biasing said indicating fuse-link cable to an indicating open-circuit position;
(f) only the second relatively low-current-interrupting, standard-type, fuse-link fusing on relatively low-current interruptions whereby on relatively low-current interruptions the said second low-current-interrupting standard-type, fuse-link only need be replaced in a refusing operation;

(g) the said fusible device so operating and the said first and second fuse sections so functioning as to simultaneously fuse on high-current interruptions so that two resultant series arcs are thereby established on such high-current interruptions; and, (h) the two fusible sections remaining electrically and mechanically interconnected following any type of fuse rupture.

28. A composite dual-acting protective fuse assembly comprising, in combination:

(a) means defining a high-current current-limiting completely enclosed high-current-interrupting fuse section comprising one or more current-limiting fuse links;

(b) means defining a low-current expulsion-type interrupting fuse section having a standard-type fuse-link disposed therein;

(c) means connecting a flexible fuse-link cable to said standard-type fuse-link;

(d) means biasing said flexible fuse-link cable to a position externally of said low-current expulsion-type interrupting fuse section;

(e) means removably mechanically interconnecting the high-current current-limiting interrupting fuse section and the low-current expulsion-type interrupting fuse section mechanically together for separable replacement, so that the fuse elements of the two fuse sections are connected electrically in series;

(f) the device functioning upon low-current interruption by the fusion of only the low-current standard-type fuse-link, whereas the companion current-limiting fuse element of the high-current fuse section remains intact;

(g) the device functioning during high-current fault current interruption so that both fuse sections simultaneously fuse to interpose thereby two arcs in electrical series into the circuit with the concomitant interrupting action being exerted on both such simultaneously-drawn series arcs;

(h) said biased indicating flexible fuse-link cable being completely pulled out of the low-current expulsion-type interrupting fuse section following any type of overcurrent fault condition to a completely visible open-gap disconnecting open-circuit position, thereby indicating to maintenance personnel the "blowing" of said fuse assembly; and, (i) the two fusible sections remaining electrically and mechanically interconnected following any type of fuse rupture.

29. The combination according to claim 28 wherein the low-current interrupting fuse section comprises an expulsion fuse-tube having an open end, and the mechanically biased flexible fuse-link cable of the standard-type fuse-link being completely retracted out of the open end of the said expulsion fuse-tube following any type of fuse operation of said low-current expulsion-type fuse section to a visible open-gap disconnecting position, thereby indicating to maintenance personnel at a distance the operation of said protective fuse assembly.

* * * * *